US005169291A

United States Patent [19]

Zebuhr

[11] Patent Number: 5,169,291

[45] Date of Patent: Dec. 8, 1992

[54] WATER HEATER WITH SHUT-OFF VALVE

[75] Inventor: William H. Zebuhr, Nashua, N.H.

[73] Assignee: Vaughn Thermal Corporation, Salisbury, Mass.

[21] Appl. No.: 704,564

[22] Filed: May 20, 1991

[51] Int. Cl.[5] ..... F16K 21/18; F16K 31/22; F16K 33/00

[52] U.S. Cl. ..... 417/41; 122/13.1; 126/362; 137/444; 137/446; 137/625.66; 222/67; 222/249; 417/393; 417/397

[58] Field of Search ..... 122/13.1, 505; 126/361, 126/362; 222/249, 67; 137/386, 434, 443, 444, 446, 625.25, 625.66, 565, 565.2; 417/41, 393, 397

[56] References Cited

U.S. PATENT DOCUMENTS

| | | | |
|---|---|---|---|
| 1,114,019 | 10/1914 | Morris | 417/41 |
| 1,114,575 | 10/1914 | Blanchard | 137/443 |
| 1,427,793 | 9/1922 | Emerson | 417/41 |
| 1,787,601 | 1/1931 | Swanberg | 137/41 |
| 2,814,305 | 11/1957 | Sturman | 137/441 |
| 3,756,269 | 9/1973 | Brown | 137/446 |
| 4,064,907 | 12/1977 | Billington et al. | 137/446 |
| 4,378,784 | 4/1983 | Frank . | |
| 4,437,484 | 3/1984 | Laing et al. . | |
| 4,541,464 | 9/1985 | Christiansen | 137/446 |
| 4,658,760 | 4/1987 | Zebuhr | 417/393 |
| 4,867,654 | 9/1989 | Zebuhr | 417/393 |
| 5,007,450 | 4/1991 | Babb et al. | 417/41 |

*Primary Examiner*—George L. Walton
*Attorney, Agent, or Firm*—Schiller & Kusmer

[57] ABSTRACT

A water heater (10) has a pressure-transfer module (20) interposed between an external pressurized-water circuit and the water inside the water-heater vessel (12) so that the water is at atmospheric pressure and can thus have a free upper surface. A shut-off valve in the inlet (14) to the pressure-transfer module (20) is controlled in accordance with the water level as detected by a float (74). If the water level falls below a predetermined minimum or exceeds a predetermined maximum, the shut-off valve closes so as to prevent further flow into the water heater (10) from the upstream side of the exterior circuit.

20 Claims, 4 Drawing Sheets

WATER HEATER WITH SHUT-OFF VALVE

BACKGROUND OF THE INVENTION

The present invention is directed to water heaters and similar systems in which a liquid reservoir is interposed in a pressurized line.

Most water heaters include a pressure vessel that admits water supplied under pressure and, after heating, supplies the heated water under pressure to faucets and other terminal devices in the house that the water heater serves. Although water heaters do generally provide a reasonably long useful life, all eventually fail, and some common failure modes involve a rupture or leak of the pressure vessel. Such a failure can result in the release of a large amount of water; the water release can continue indefinitely if it is not detected, and in some cases the resultant economic loss is considerable.

It would therefore seem desirable to provide water heaters with automatically operated shut-off valves that stop the flow of water into the vessel when a leak occurs. Few such water heaters exist, however, because it is not ordinarily convenient to detect a leak by monitoring readily sensed physical quantities. For example, water pressure would not be a good leak indicator, because the pressure reduction, if any, caused by a leak would not be any greater than that which results from ordinary hot-water use unless the leak resulted from an atypically severe rupture. To sense a leak would therefore require a more-elaborate sensing scheme, such as a sensor for monitoring for moisture on the floor near the water heater. Clearly, such an approach would only rarely be practical.

SUMMARY OF THE INVENTION

I have found that a water heater's liquid-containing vessel can be so modified as to make its liquid level indicative of a significant leak. Specifically, I employ a pressure-transfer module, such as one of those described in my previous U.S. Pat. Nos. 4,658,760 and 4,867,654, to reduce the liquid in the vessel to atmospheric pressure and thus permit it to have a free upper surface. As is described in more detail in those patents, which I hereby incorporate by reference, the pressure-transfer module ordinarily permits significant water flow into the vessel only when downstream demand causes the pressure-transfer module to pump water out of the vessel. Unlike a leak in a conventional water-heater vessel, therefore, a significant leak in the vessel of my water heater results in a water-level drop. By providing a water-level sensor and an inlet valve that responds to the sensor's detection of too low a level by closing the inlet, I automatically limit the damage that such a leak can cause. Such an arrangement is particularly easy to provide because the level-operated shut-off valve can share the sensor and some other valve-operator parts with the bypass-valve system that a pressure-transfer module typically employs to compensate for its flow-rate gain.

Another aspect of the invention prevents the overflow that might otherwise result from a pressure-transfer-module leak that allows a significant water flow into the vessel without causing a corresponding flow out through the normal outlet. Systems that embody this aspect of the invention are so arranged as to close the shut-off valve when the liquid level is too high.

BRIEF DESCRIPTION OF THE DRAWINGS

These and further features and advantages of the present invention are described below in connection with the accompanying drawings, in which.

DETAILED DESCRIPTION OF ILLUSTRATIVE EMBODIMENTS

Figure 1:
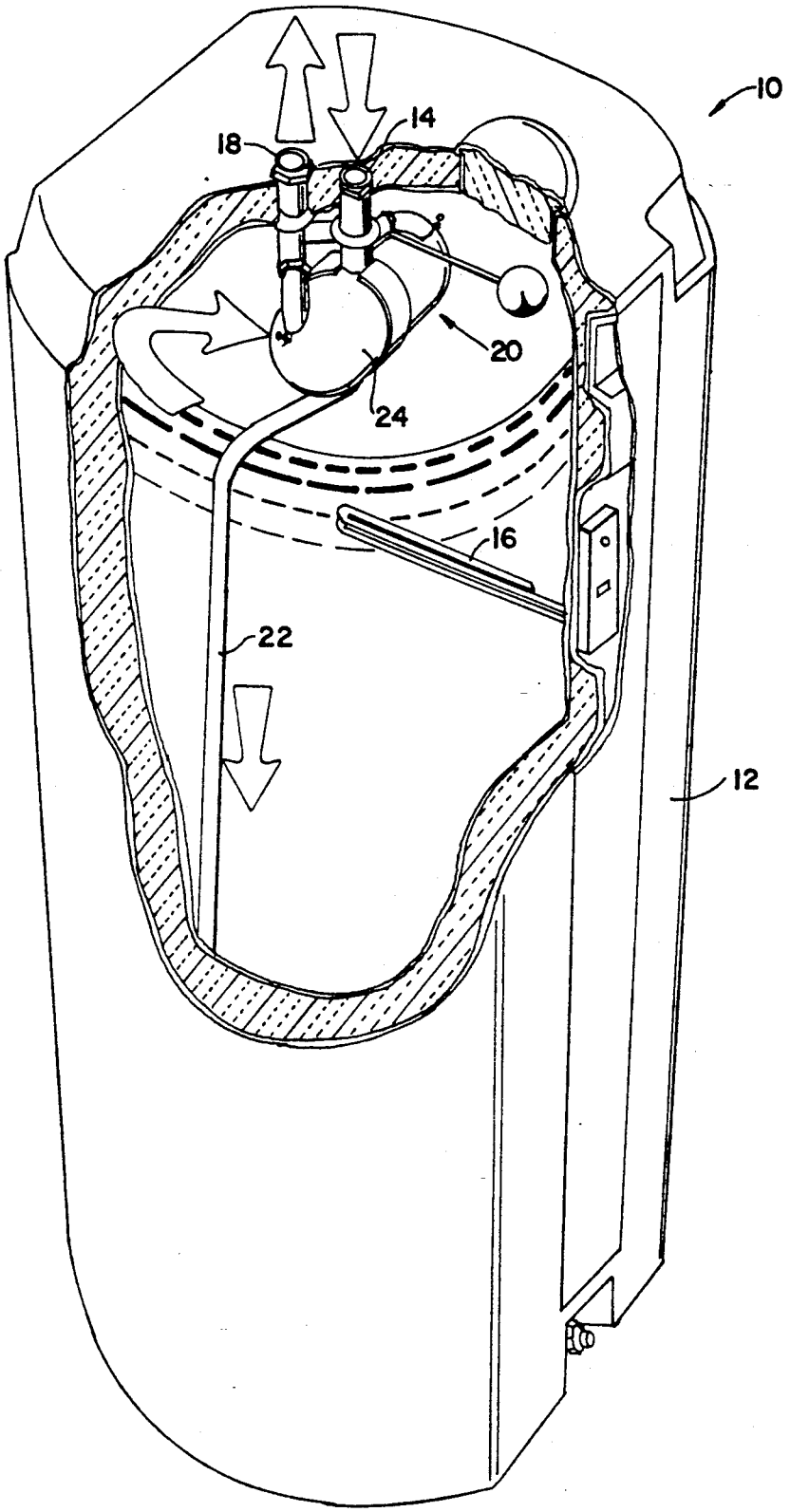
FIG. 1 is a perspective view, partly broken away, of a water heater that embodies the teachings of the present invention.

Like most Water heaters, the water heater 10 of the present invention depicted in FIG. 1 includes a vessel 12 that acts as a reservoir in a pressurized line. Cold water flows through a cold-water inlet 14 to the interior of the vessel 12, where it is heated by appropriate means such as a gas or oil burner, a solar collector, or the electric heating element 16 depicted in the drawings. Water thus heated is then discharged through an outlet 18.

As described so far, the water heater 10 of the present invention is substantially identical to conventional water heaters, with the exception that the vessel 12 is depicted as being somewhat rectangular in cross section rather than completely circular. This shape, which has advantages for storage and transportation, is practical because cold water flowing through the inlet 14 to the vessel interior must pass through a pressure-transfer module (PTM) 20, which reduces the water pressure to atmospheric before discharging it into the vessel interior by way of a dip tube 22, which directs the incoming cold water to the bottom of the vessel 12 for heating. The vessel interior is thus at essentially atmospheric pressure. The PTM uses the power in the fluid flow across this pressure difference to pump water from the vessel interior to the hot-water outlet 18 at a pressure nearly equal to that at the inlet 14.

This mode of operation has a number of advantages. One of those, described in my previous patents mentioned above, is that the resultant atmospheric pressure in the vessel interior does not require the vessel to be nearly as strong as those that conventional water heaters require. The vessel can thus be made of materials that are much less expensive, and the rectangular shape alluded to above becomes practical.

Of more relevance to the present invention, however, is that the atmospheric pressure permits the water to have a free upper surface, typically just above the top of the pressure-transfer-module housing 24, and the level of this free surface can be used as a failure indication. By placing a shut-off valve in the inlet 14 and controlling it in response to the water level, therefore, one can shut the water off in response to certain types of failures, as will be described in more detail below after a digression to a brief review of the pressure-transfer-module operation described in more detail in my previously mentioned patents.

Figure 2:
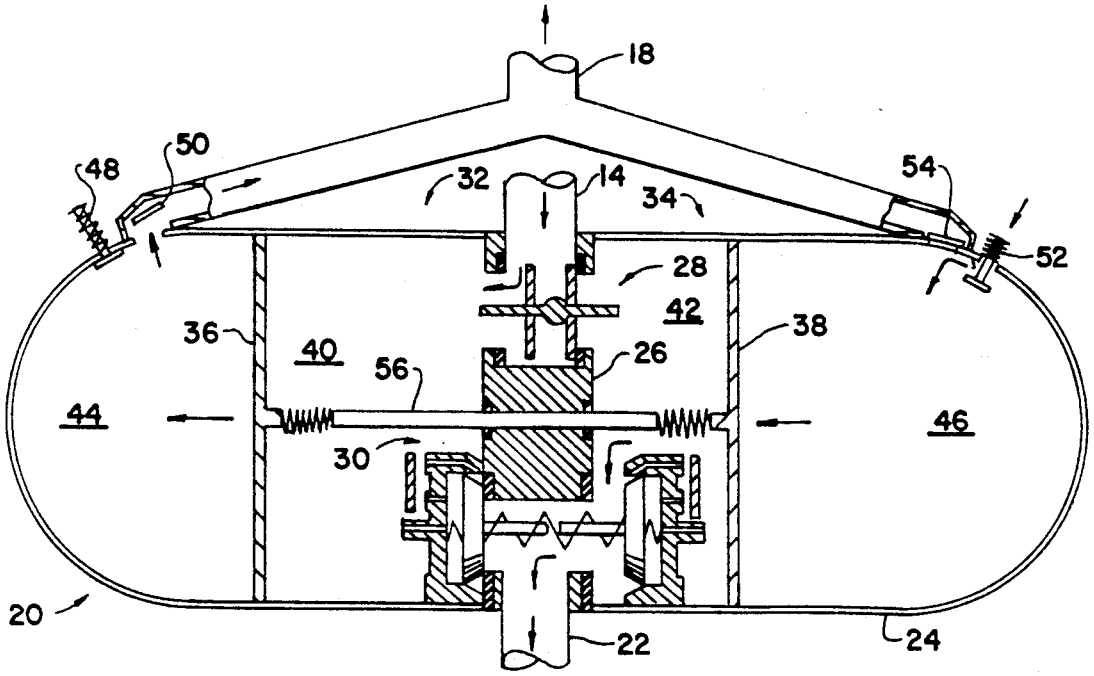
FIG. 2 is a diagrammatic view of the pressure-transfer module employed in the water heater of FIG. 1.

FIG. 2 depicts the interior of the pressure-transfer-module housing 24 as being divided by a central wall 26 and drive inlet and outlet valve assemblies 28 and 30 into left and right cylinders 32 and 34. Left and right pistons 36 and 38 divide the left and right cylinders 32 and 34 into left and right drive chambers 40 and 42 and left and right pump chambers 44 and 46. Water enters one of the drive chambers 40 and 42 by way of the cold-water inlet 14 and the drive inlet valve 28, and it leaves the other of those drive chambers through the drive-outlet-valve assembly 30 and the dip tube 22. Fluid communication with the left pump chamber 44 occurs by way of left inlet and outlet check valves 48 and 50, while similar communication with the right pump chamber 46 occurs by way of similar check valves 52 and 54.

Specifically, when valves 28 and 30 are in the state shown in FIG. 2, water from the inlet 14 can enter the left drive chamber 40 but cannot leave it through the dip tube 22, so the inlet pressure drives the left piston 36 to the left, and thereby drives water from the left pump chamber 44 through check valve 50, if a load (e.g., an open faucet) downstream of the outlet 18 permits water flow. In the absence of a downstream load, no flow occurs, and the left piston 36 remains stationary despite the inlet pressure.

A piston rod 56 connects the left piston 36 to the right piston 38 so that piston 38 moves to the left with piston 36. This movement drives water from the right drive chamber 42 into the vessel 12 through the dip tube 22, and, because the housing 24 is typically submerged, draws water through check valve 52 into the right pump chamber 46. Pumping of hot water into the downstream circuit in response to a load is thus accompanied by flow of cold water from the upstream circuit into the vessel 12, while the absence of a load not only prevents water from being pumped out of the pressure-transfer module 20 but also, with a minor exception that will be described presently, prevents it from entering the vessel.

Figure 3:
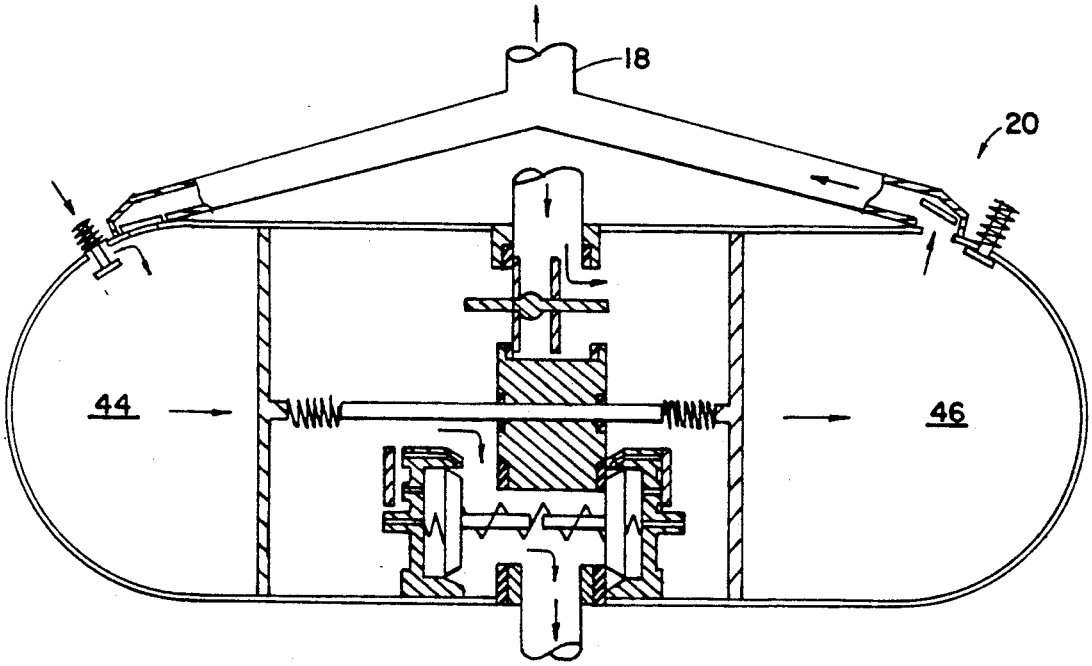
FIG. 3 is a similar diagrammatic view depicting the pressure-transfer module in the valve state opposite that shown in FIG. 2.

When the pistons reach a leftward limit point, the valves change to the states depicted by FIG. 3, and the pressure-transfer module 20 draws water from the vessel interior into the left pump chamber 44 rather than into the right pump chamber 46, from which water is now pumped through the outlet 18 to the load.

Since no part of the invention depends on the particular type of PTM used, the foregoing discussion merely outlines operation of an exemplary PTM. For the specifics of a particularly advantageous PTM, one can refer to the U.S. patent application Ser. No. 703,214 of William H. Zebuhr for an Improved Pressure-Transfer Module, which was filed on May 20, 1991.

Figure 4:
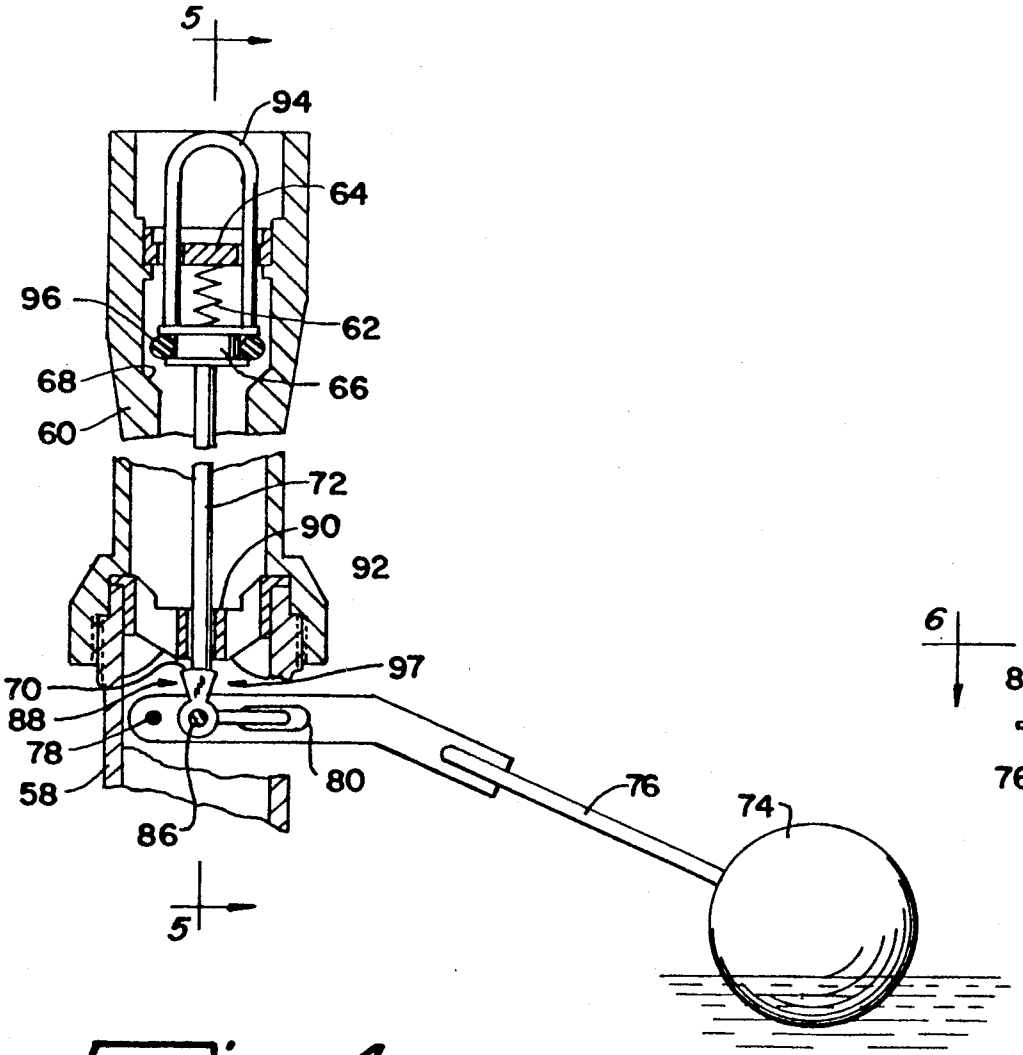
FIG. 4 is a cross-sectional view of the shut-off valve employed in the water heater of the present invention.

Having completed our review of PTM operation, we now turn to the shut-off-valve operation that the teachings of the present invention make possible. FIG. 4 depicts in cross-section an inlet conduit 58 that forms the inlet 14 of FIGS. 2 and 3. A valve housing 60 is threadedly connected to the upper end of the inlet conduit 58. Housing 60 is part of a shut-off valve in which a spring 62, anchored by a stop member 64 secured in the housing 60, urges a valve member 66 toward a valve seat 68 formed by the interior surface of the housing 60. In ordinary operation, however, a shut-off-valve cam 70 acts against a valve stem 72 to prevent closure of the shut-off valve.

Like the shut-off-valve cam 70, a float 74 disposed in the vessel interior forms part of a shut-off-valve operator that controls the state of the shut-off valve. The float 7 is connected to a shut-off-valve operator arm 76 that pivots with motion of the float 74 about an arm axis 78. An elongated slot 80 in the operator arm 76 receives the handle 82, shown more clearly in FIG. 6, of a crank 84, which accordingly pivots about its crank axis 86 when the float 74 moves. The shut-off-valve cam 70 is so secured to the crank 84 as to pivot with it about the crank axis 86.

The cam 70 ordinarily prevents closure of the shut-off valve, as was just explained. This is a result of the fact that, as will be explained below, ordinary operation of the pressure-transfer module 20 maintains the water at such a level that the cam 70 is disposed near the position depicted in FIG. 4. If the vessel 12 springs a leak, however, the resultant flow out of the vessel is not accompanied by flow into it, and the water level accordingly falls if the leak is significant. When this falling level results in enough rotation of the shut-off-valve cam 70 that a relieved region 88 at the left side of the cam 70 comes under the valve stem 72, the stem 72 and the valve member 66 drop.

Guided by a bushing 90 held in place by a flow-permitting spider 92, and further guided by guide surfaces on stop member 64, which engage a U-shaped extension 94 of the valve member 66, the valve member 66 is driven by the shut-off-valve spring 62 into a position in which an O-ring 96 carried by the valve member 66 seals against the valve seat 68 and prevents any further flow into the inlet 14. Unlike conventional water heaters, therefore, a water heater that employs the teachings of the present invention will automatically prevent major leaks from releasing more than a single vessel volume of water.

According to another aspect of the present invention, the water heater automatically limits the damage that can result from another failure mode, namely, a failure of the pressure-transfer module 20, or of the connections to it, that permits significant water flow from the inlet 14 into the vessel 22 without causing a corresponding removal through the outlet 18. Such a defect could cause the vessel 22 to overflow and again result in significant water damage if no steps were taken to prevent it. But another relieved region 97 is provided on the right side of the shut-off-valve cam 70 according to this aspect of the present invention to permit shut-off-valve closure if the water level rises too high. The shut-off valve thus is so controlled as to limit damage not only from vessel leaks but also from pressure-transfer-module failures.

A shut-off valve of the illustrated type is particularly economical because it can also be so implemented as to use a number of parts that, in order to provide a bypass function, a PTM often already includes. The bypass function compensates for the flow-rate gain designed into the pressure-transfer module. As can be appreciated by returning to FIGS. 2 and 3, the presence of the piston rod 56 in the drive chambers 40 and 42 makes the effective areas of those chambers less than those of the pump chambers 44 and 46. A given volume of flow through the drive chambers 40 and 42 therefore causes a higher volume of flow through outlet chambers 44 and 46. Some such flow-rate gain is desirable in order to compensate for the water's thermal expansion and for various flow losses in the drive side of the PTM. Since thermal expansion varies and the exact magnitudes of the losses are not known beforehand, however, the flow-rate gain is designed to overcompensate for these factors, and PTM operation would accordingly tend to reduce the water level in the vessel in the absence of countervailing measures.

Figure 5:
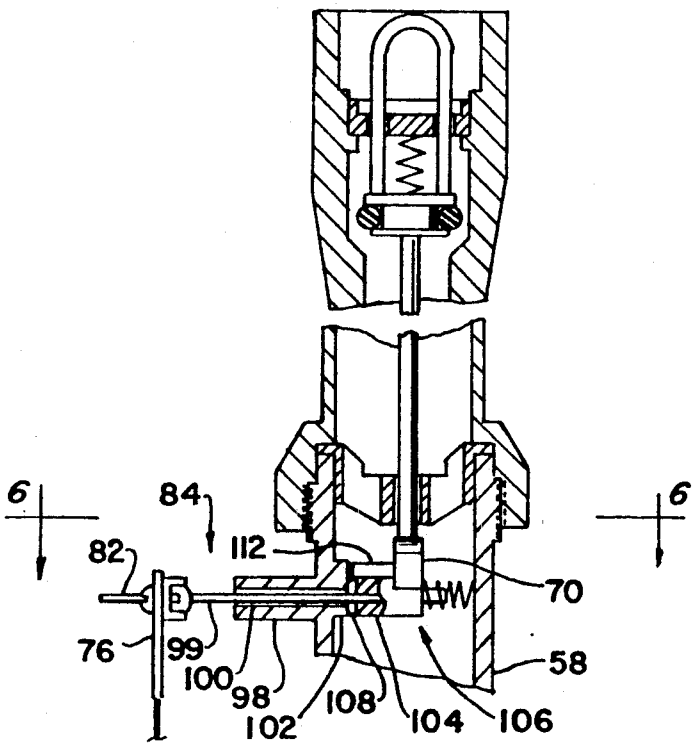
FIG. 5 is a cross-sectional view taken at line 5—5 of FIG. 4 and further illustrating the bypass valve employed in accordance with certain aspects of the invention.
Figure 6:
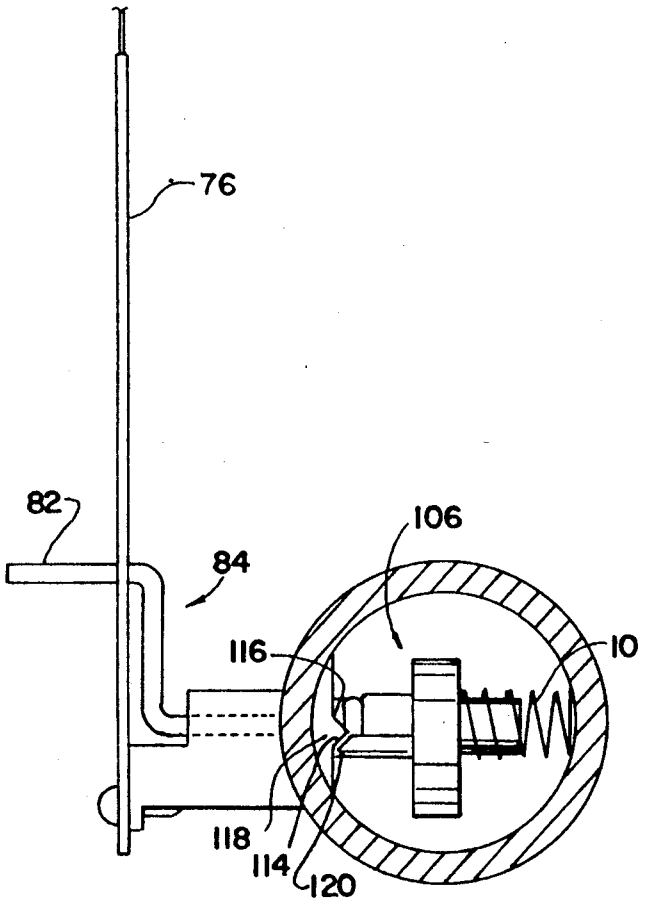
FIG. 6 is a cross-sectional view of the inlet conduit taken at line 6—6 of FIG. 5.

The pressure-transfer module 20 therefore includes a bypass conduit that leads to the vessel from the inlet but bypasses the drive chambers. Unaccompanied by a corresponding flow through the outlet 18, this bypass flow reduces the effective flow-rate gain of the PTM. A bypass valve controls the bypass flow, and thus the effective flow-rate gain, in response to the water level. The illustrated embodiment of my invention employs the same float 74 to control both the bypass valve and the shut-off valve. FIGS. 5 and 6 depict the bypass-valve operation.

FIG. 5 shows that the inlet conduit 58 includes a horizontally extending sleeve portion 98 by which the shaft 99 of the crank 84 enters the interior of the inlet conduit 58. The bypass conduit mentioned above is a narrow channel 100 formed as an elongated groove in the sleeve bore through which the shaft 99 extends. By flowing from the inlet 14 through the bypass channel 100, water reaches the vessel interior without going through either drive chamber.

The interior wall of the inlet conduit 58 forms a valve seat 102 across which water must pass to enter the bypass channel 100, and a bypass valve member 104 provided as part of the same shaft-mounted member 106 that provides the shut-off-valve cam 70 can move axially (with the crank 84) so as to seal the bypass-valve seat 102 with an O-ring 108 that it carries in a recess in its right face. A spring 110 urges the bypass valve toward this closed position, but an axially acting bypass cam 112 engages complementary inclined surface 114 or 116 on the interior wall of conduit 58, as can be seen more clearly in FIG. 6, so as to control the axial position of the bypass-valve member 104 in accordance with the rotational position of the common shaft-mounted member 106. In other words, the water level controls the state of the bypass valve.

Within the range of float levels that cause cam 70 to prevent shut-off-valve closure, there is an operating range in which one inclined surface 118 of the bypass-valve cam 112 engages complementary wall surface 114, as FIG. 6 shows. At the upper end of this range, the resultant camming action permits the spring 110 to move the shaft-mounted member 106, and thus its bypass-valve portion 104, to the leftward position in which the bypass-valve O-ring 108 seals the bypass-valve seat 102 and thus prevents bypass flow. The PTM's full potential flow-rate gain is thus in effect at the upper end of the operating range. Toward the lower end of this range, on the other hand, the camming action keeps the bypass valve open far enough to keep the flow-rate gain low, preferably at a value below unity. In normal operation this "negative feedback" suffices to maintain the water at an intermediate level in the operating range.

If the water level falls below the operating range, the cause is probably a defect such as a serious vessel leak, and permitting flow through the bypass channel is therefore counterproductive. To deal with this situation, the pressure-transfer module 20 also includes cam surface 120 and the complementary wall surface 116. These surfaces engage when the water level falls below the operating range. In this regime, a water-level drop causes the bypass flow to decrease, and ultimately to stop, so that bypass flow does not contribute to the leakage.

As the foregoing discussion illustrates, the shut-off-valve operator can share a number of parts with the bypass-valve operator. Specifically, the two operators share the float 74, the operator arm 76, and the crank 84. Additionally, a single unitary part 106 provides not only both the cams 70 and 112 but also the bypass-valve member 104. The shut-off valve can thus be added by providing little more than its valve member 66 and a valve stem 72 for actuating it and making a minor modification in the existing inlet conduit to provide a seat 68 for the valve.

In the illustrated embodiment, the left and right relieved regions 88 and 97 provide surfaces that are substantially radial with respect to the cam pivot axis, and a return of the water level to the proper rang accordingly does not result in the shut-off-valve's being opened by rotation of the cam 70; to reset the system, one must remove the upstream fluid line and withdraw the valve member 66 by pulling upward on its U-shaped extension 94 while the water level is in the operating range. This is a simple operation and is required only when the water heater is initially installed and when a failure occurs. Still, one can modify the arrangement of FIGS. 4, 5, and 6 to reduce or eliminate the number of occasions in which such an operation is needed.

Figure 7:
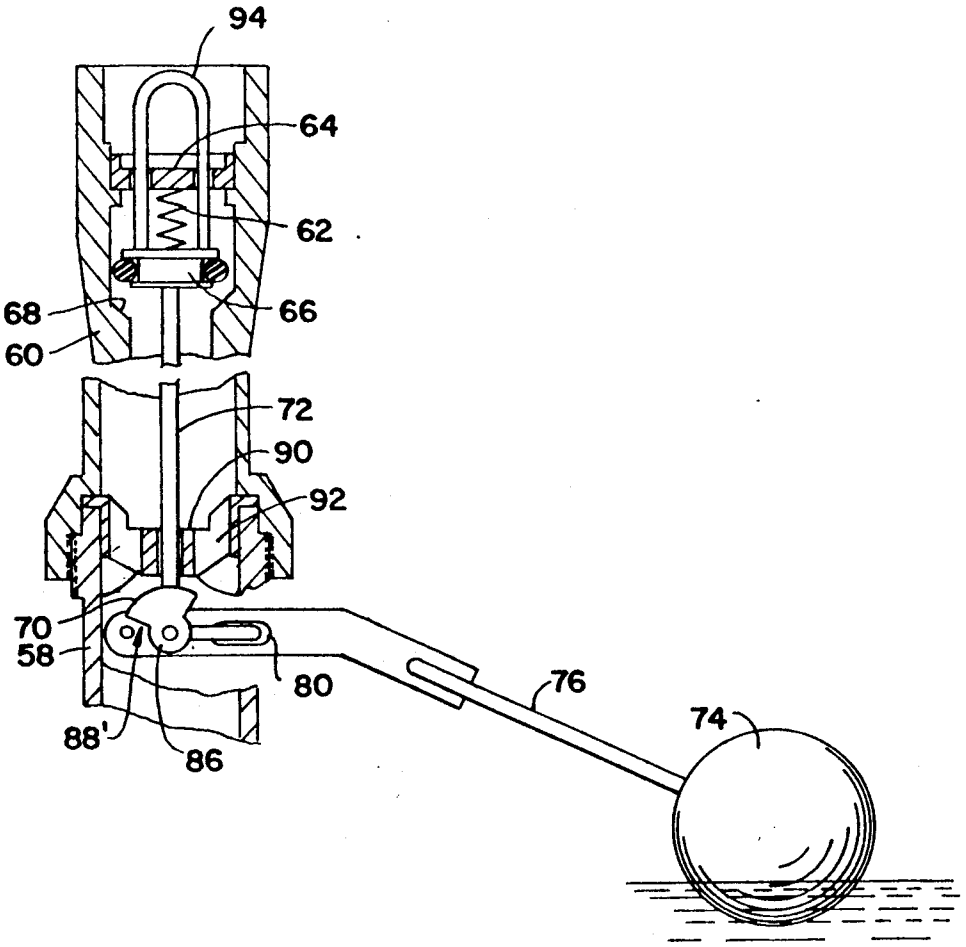
FIG. 7 is a cross-sectional view similar to FIG. 4 of an alternate embodiment of the present invention.

For example, a shut-off-valve cam shaped as illustrated in FIG. 7 can be used if the low vessel pressure that results from PTM use reduces the likelihood of vessel failure to such an extent that shut-off-valve protection is considered important only against a failure of the PTM and connections to it, not against vessel leaks. In the FIG. 7 arrangement, the left relieved region 88' is displaced considerably counterclockwise from the position of relieved region 88 of FIG. 4. The interference of the float 74 with the PTM housing prevents the operator arm 76 from pivoting far enough to position relieved region 88' under valve stem 72 and thus allow the shut-off valve to close. The water heater (or replacement PTM) can therefore be installed without performing the above-described resetting operation, which is required only after the shut-off valve has closed because of too high a water level.

One could also eliminate the resetting operation completely by so shaping cam 70 that it cams the valve open when the water level returns to the desired range. However, I prefer the sharp closing action that results from the illustrated arrangement.

Of course, the broader teachings of the present invention can be embodied in a device that does not use a single unitary member such as member 106 to provide the three features just mentioned, and the operators for the two valves need not have a float and an operator arm in common. Indeed, the water level could be sensed by a level sensor completely different from a float. However, I believe that the illustrated arrangement provides significant cost and complexity advantages.

The present invention thus provides an easily implementable solution to a long-existing problem and therefore constitutes a significant advance in the art.

I claim:

1. For providing a liquid reservoir in a pressurized liquid line, an apparatus comprising:

A) a vessel containing fluid at atmospheric pressure;

B) a pressure transfer module including a drive inlet adapted for connection to a pressurized inlet line, and a drive outlet, a fluid driven pump having a pump inlet, and a pump outlet, said pump being operable by flow of liquid into said drive inlet, through said pump, and out said drive outlet to draw liquid into said pump inlet through said pump, and out said pump outlet; said drive outlet and said pump inlet being so disposed in communication with the interior of said vessel that fluid that has flowed from said drive inlet through said pump and out said drive outlet is discharged into said vessel, and that fluid thus contained in said vessel is drawn by said pump from said vessel into said pump inlet, through said pump, and out through said pump outlet, whereby pressure is effectively transmitted from said fluid at said drive inlet to said fluid at said pump outlet without imposing said pressure on said fluid in vessel;

a shut-off valve disposed at said pump inlet and operable between an open state, wherein said valve permits liquid to enter said drive inlet, and a closed state, wherein said valve prevents liquid from entering said drive inlet; and a shut-off-valve operator including a level sensor indicative of the liquid level in said vessel, said shut-off-valve operator being responsive to said liquid level as indicated by said level sensor to operate said shut-off valve from said open state to said closed state when said liquid level falls below a predetermined minimum level.

2. An apparatus as defined in claim 1 further including:

A) a bypass conduit providing a bypass passage around said pump from said drive inlet to the vessel interior;

B) a bypass valve operable between a closed state, wherein said bypass valve prevents liquid flow through said bypass conduit, and an open state, wherein said bypass valve permits such flow; and C) a bypass-valve operating including said level sensor also included in said shut-off-valve operator, said bypass-valve operator being responsive to the liquid level in said vessel to operate said bypass valve to said open state when said level is at the lower end of a predetermined operating range and to close said bypass-valve when said level is at the upper end of said operating range.

3. An apparatus as defined in claim 2 wherein said level sensor is a float disposed in said vessel.

4. An apparatus as defined in claim 3 wherein:

A) said shut-off and bypass valves include respective shut-off and bypass cams, respectively;

B) said shut-off and bypass valves operate in response to rotation of said shut-off and bypass cams, respectively; and C) said shut-off and bypass valves include a common operator arm so connected to said float and said shut-off and bypass cams as to rotate said cams about a common cam axis in response to changes in the level of said float.

5. An apparatus as defined in claim 3 further including means for heating liquid contained in said vessel.

6. An apparatus a defined in claim 2 wherein said bypass operator is also responsive to the liquid level in said vessel as indicated by the level sensor to operate the bypass valve to said closed state when said liquid level falls below a predetermined cut-off level below the operating range of said float.

7. An apparatus as defined in claim 2 wherein said shut-off valve is also responsive to the liquid level in said vessel as indicated by said level sensor to operate said shut-off valve from its open state to its closed state when the liquid level falls below a predetermined minimum level.

8. An apparatus as defined in claim 2 further including means for heating liquid contained in said vessel.

9. An apparatus as defined in claim 1 wherein said shut-off-valve is also responsive to the liquid level in said vessel as indicated by said level sensor so as to operate said shut-off valve from its open state to its closed state when said liquid level falls below a predetermined minimum level.

10. An apparatus as defined in claim 9 further including means for heating liquid contained in said vessel.

11. An apparatus as defined in claim 1 wherein said level sensor is a float so disposed in said vessel that its position within a range thereof is indicative of the liquid level in said vessel.

12. An apparatus as defined in claim 1 further including means for heating liquid contained in said vessel.

13. For providing a liquid reservoir in a pressurized liquid line, an apparatus comprising:

A) a vessel for containing fluid at atmospheric pressure;

B) a pressure transfer module including a drive inlet, and a drive outlet, a fluid-driven pump having a pump inlet, and a pump outlet, said pump being operable by flow of liquid into said drive inlet, through said pump, and out said drive outlet to draw liquid in said pump inlet, through said pump, and out said pump outlet, said drive outlet and said pump inlet being so disposed in communication with the interior of said vessel that fluid that has flowed from said drive inlet through said pump and out said drive outlet is discharged into said vessel and that fluid thus contained in said vessel is drawn by said pump from said vessel into said pump inlet, through said pump, and out through said pump outlet;

a shut-off valve disposed at said pump inlet and operable between an open state, wherein said shut-off valve permits liquid to enter said drive inlet, and a closed state, wherein said shut-off valve prevents liquid from entering said drive inlet; and a shut-off-valve operator including a level sensor indicative of the liquid level in said vessel, said shut-off-valve operator being responsive to the liquid level in said vessel as indicated by said level sensor so as to operate said shut-off valve from its open state to its closed state when said liquid level falls below a predetermined minimum level.

14. An apparatus as defined in claim 13 further including:

A) a bypass conduit providing a bypass passage around said pump from said drive inlet to the interior of said vessel;

B) a bypass valve operable between a closed state, wherein said bypass valve prevents liquid flow through said bypass conduit, and an open state, said bypass valve permits such flow; and C) a bypass-valve operator including said level sensor, said bypass-valve operator being responsive to the liquid level in said vessel to operate said bypass valve to its open state when said level is at the lower end of a predetermined operating range and to close said bypass valve when said level is at the upper end of said operating range.

15. An apparatus as defined in claim 14 further including means for heating liquid contained in said vessel.

16. An apparatus as defined in claim 14 wherein said bypass operator is also responsive to the liquid level in said vessel as indicated by said level sensor to operate said bypass valve to its closed state when said liquid level falls below a predetermined cut-off level.

17. An apparatus as defined in claim 14 wherein said level sensor is a float so disposed in the vessel that its position within a range thereof is indicative of the liquid level in said vessel.

18. An apparatus as defined in claim 17 further including means for heating liquid contained in said vessel.

19. An apparatus as defined in claim 15 wherein:

A) said shut-off and bypass operators include respective shut-off and bypass cams;

B) said shut-off and bypass valves operate in response to rotation of said shut-off and bypass cams, respectively; and C) said shut-off and bypass operators include a common operator arm so connected to said float and said shut-off and bypass cams as to rotate the latter about a common cam axis in response to changes in the level of said float.

20. An apparatus as defined in claim 13 further including means for heating liquid contained in said vessel.

* * * * *